United States Patent [19]

Berenguer

[11] 4,117,874

[45] Oct. 3, 1978

[54] PORTABLE ARTICLE CARRIER

[76] Inventor: Antonio Subiros Berenguer, Calle Modolell, 6, Barcelona, Spain

[21] Appl. No.: 780,191

[22] Filed: Mar. 22, 1977

[30] Foreign Application Priority Data

May 6, 1976 [ES] Spain ..... 220.945[U]

[51] Int. Cl.[2] ..... B65D 31/00

[52] U.S. Cl. ..... 150/1.7

[58] Field of Search ..... 150/1.7, 28 R, 33, 35

[56] References Cited

U.S. PATENT DOCUMENTS

| | | | |
|---|---|---|---|
| 1,305,797 | 6/1919 | Henderson | 150/1.7 X |
| 1,666,704 | 4/1928 | Hunter | 150/1.7 |
| 2,038,952 | 4/1936 | Niedorff | 150/1.7 |
| 3,989,080 | 11/1976 | Koszegi | 150/1.7 |

*Primary Examiner*—Donald F. Norton

*Attorney, Agent, or Firm*—Steinberg & Blake

[57] ABSTRACT

A bag, e.g. a shopping bag, which is made of foldable material, is provided with a case, smaller than the bag, secured to the bag adjacent the mouth thereof. The case has two compartments, one of which serves for storage of the bag, when appropriately folded, and the other of which can be used as a purse. The bag can thus be conveniently packed away in the case when not in use.

5 Claims, 6 Drawing Figures

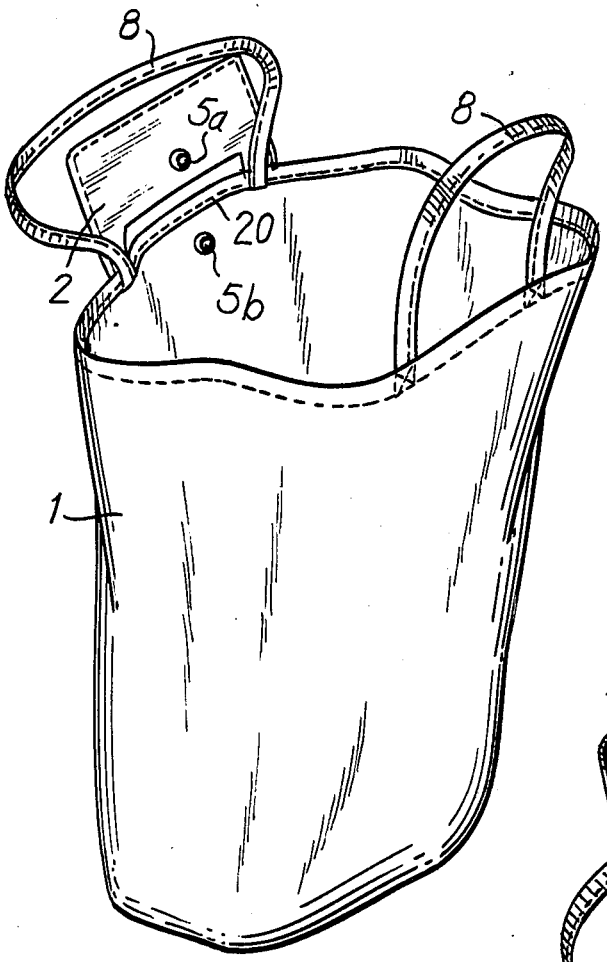
FIG. 4
FIG. 5
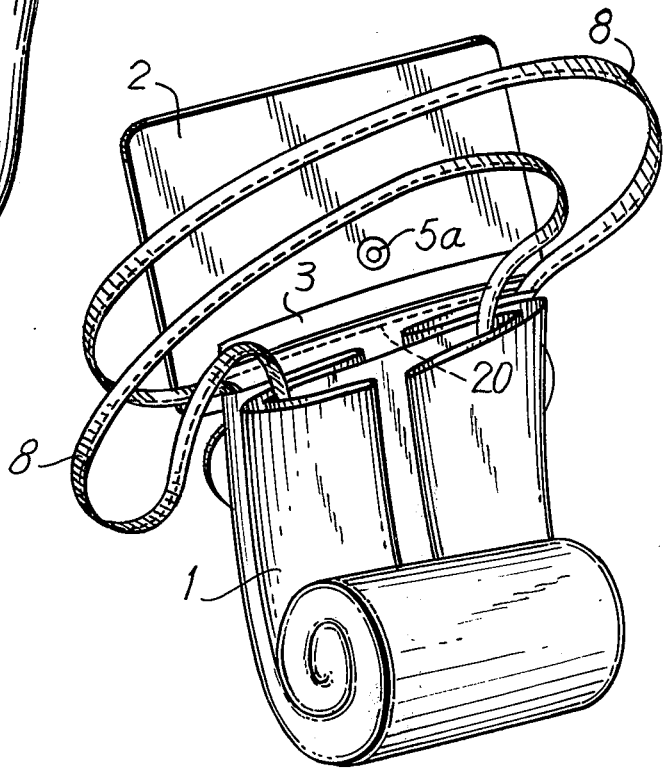
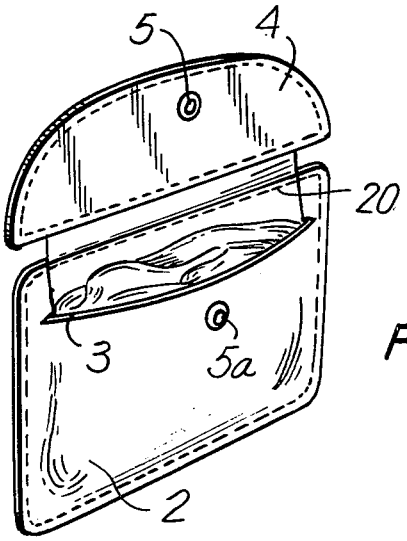
FIG. 6

PORTABLE ARTICLE CARRIER

BACKGROUND OF THE INVENTION

1. FIELD OF THE INVENTION

This invention relates to foldable bags, suitable to be hand held and useful for the carriage of goods, such as shopping bags.

2. DESCRIPTION OF THE PRIOR ART

A capacious bag, though very useful for such purposes as carrying shopping, can be an encumbrance when empty, particularly when it is remembered that the user may also have to carry a purse.

SUMMARY OF THE INVENTION

An object of the invention is to provide a bag which can be conveniently stowed away when not required for use.

A further object of the invention is to provide such a bag which includes a purse.

Yet another object of the invention is to provide a bag which is simple and yet highly practical.

The present invention comprises a bag having a bag portion which can be folded into a fairly small volume and to which is attached a case wherein the bag portion can be stowed when so folded. Preferably the case is attached at or near one edge adjacent the mouth of the bag portion so that when the bag portion is unfolded for use the case hangs down substantially inside it, with the opening of the case on the side next to the wall of the bag portion and close to the site of attachment. In a preferred embodiment, the opening in the case can be closed by a flap which is provided with fixing means which engage fixing means on the body of the case below the opening in the case, and said flap is so positioned that when the bag portion is unfolded for use the flap can be folded over the rim of the bag portion so as to be substantially outside the bag portion and to engage the sealing means through an orifice in the wall of the bag portion thus holding the case to one side of the bag. When the bag portion is folded and stowed in the case, the flap covers the opening in the case. The case is provided with one or more additional closable compartments separate from, and preferably opening on the opposite side of the case from, the one for the bag so that the case may also serve as a purse, both when the bag is stowed and when it is unfolded for use.

BRIEF DESCRIPTION OF THE DRAWINGS

The preferred embodiment of the invention will be described by way of example with reference to the accompanying drawings, in which:

FIG. 4 shows, in perspective, the unfolded bag with the case raised to facilitate the folding and stowing of the bag portion;

FIG. 5 is a perspective view of the bag during folding; and

FIG. 6 shows, in perspective, the case with the bag portion disposed in the stowage compartment which has its flap open.

DESCRIPTION OF THE PREFERRED EMBODIMENT

Figure 1:
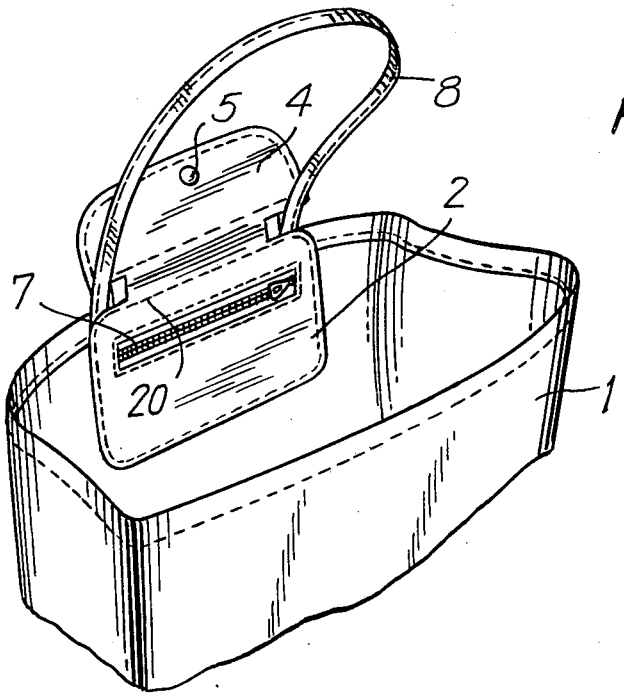
FIG. 1 is a perspective view of the upper portion of the unfolded bag embodying the invention, with the case disposed in its interior and the flap (which closes a stowage compartment) open.
Figure 2:
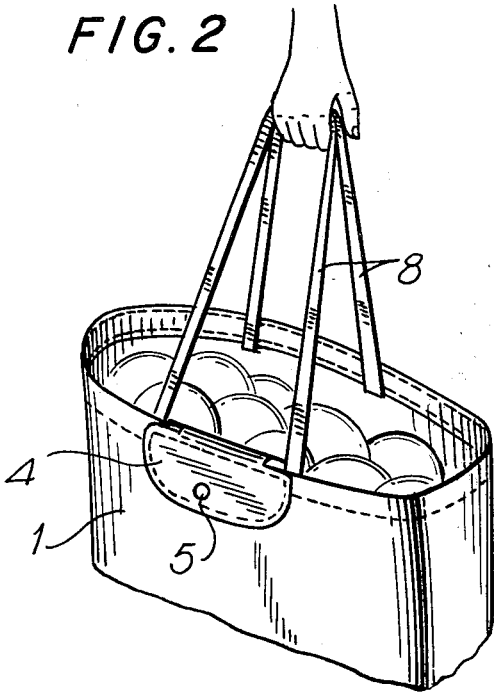
FIG. 2 shows, in perspective, the bag ready for use.
Figure 3:
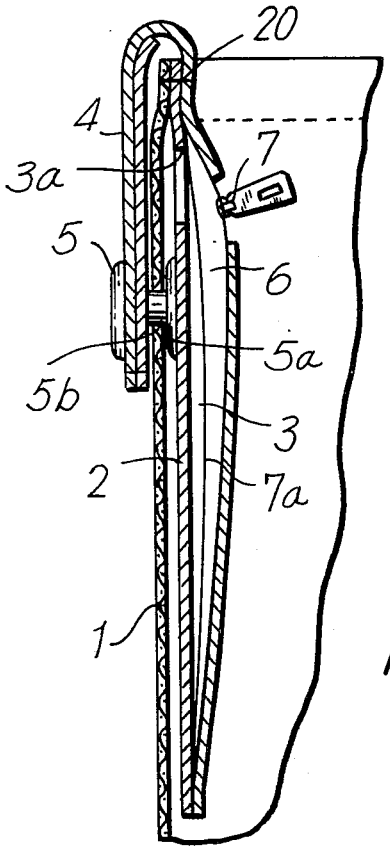
FIG. 3 is a vertical cross section through part of FIG. 2.

The bag illustrated has a bag portion 1, for carrying goods, formed of suitable flexible material and is provided with a case 2 in the form of a complete bag smaller than the bag portion 1 (in the unfolded condition of the latter). The case 2 is suitably secured to the edge of the mouth of the said bag portion 1, and is provided with a compartment 3 adapted to receive the folded bag portion 1. The compartment 3 has an access aperture 3*a* and a cover constituted by a flap 4 provided with a press stud 5 associated with the socket element 5*a* and adapted to extend through an aperture 5*b* formed in the bag.

The case 2 has a second compartment 6 having an access aperture closed by a sliding fastener 7, thus constituting a purse useful for the storage of small objects, which is separated from the first compartment 3 by a flexible wall 7*a*.

The bag is completed by a plurality of foldable carrying handles 8 for use when it is unfolded.

It will be noted that the edge of the mouth of the bag portion 1 secured to the case 2 is located adjacent to the aperture 3*a* of the compartment 3. This facilitates introduction of the bag 1 and the handles 8 (suitably folded) through the access aperture 3*a* into the interior of the compartment (FIGS. 5 and 6) in such manner that the case can be used as a conventional purse with the advantage that contained therein is a bag of considerable capacity which need not be unfolded until it is employed.

Since compartment 6 is separate from compartment 3 and has independent closure means 7, it can be used as a purse both when the bag portion 1 is stowed in the caompartment 3 and when the bag portion 1 is unfolded.

When the bag portion 1 is unfolded for use, the case 2 is held in the interior thereof by the stitching 20 of the edge adjacent to the opening of the compartment 3 and by the action of the fixing means 5 and 5*a* which extend through the eyelet 5*b* in the wall of the bag portion 1, the flap 4 being folded over the edge of the mouth of the bag portion 1. The internal position of the case 2 helps to prevent loss of the contents of compartment 6, even if the closure means 7 is left open. Furthermore, the positioning of the case adjacent to the edge of the mouth of the bag allows ready access.

Obviously, the case could in an alternative embodiment be disposed externally of the bag portion 1 thereby not contacting the contents of the latter.

The operation of folding the bag portion 1 to dispose it within the compartment 3 is extremely simple and can be effected rapidly. The flap 4 can then be secured so as to conceal the aperture 3*a*.

While the invention has been illustrated above by reference to a preferred embodiment it will be understood by those skilled in the art that various changes may be made without departing from the spirit and scope of the invention and it is intended to cover all such changes and modifications by the appended claims.

What is claimed is:

1. A portable article carrier, suitable to be hand held for carrying goods, comprising a foldable bag having a wall terminating in an upper edge defining an open mouth, and a case smaller than the bag when the latter is in an unfolded condition, said case being secured to the bag adjacent the upper edge thereof, the case having a first compartment formed with an access aperture, the first compartment and its aperture being of such a size and so arranged that the bag when appropriately folded can be stowed therein, the case further having a second compartment adapted for the storage of small objects and accessible both when the bag is unfolded and when the bag is stowed in the first compartment, said case having an upper edge secured to the bag at the upper edge of the latter and said case hanging down within the bag in the unfolded condition thereof, with said case when hanging down within the unfolded bag having said second compartment facing away from said wall of said bag toward the hollow interior of the bag so as to be freely accessible at the interior of the unfolded bag adjacent the open mouth thereof.

2. A portable article carrier according to claim 1, wherein said second compartment has an access aperture provided with closure means adapted to close the whole of the latter aperture.

3. A portable article carrier according to claim 1 wherein the case is provided with a flap which covers the aperture of the first compartment when the bag portion is stowed therein.

4. A portable article carrier according to claim 1 wherein the case is provided with a flap which covers the aperture of the first compartment when the bag is stowed therein and which extends around the upper edge of the bag in the unfolded condition of the latter, the flap and the first compartment being provided with a fixing means having mutually cooperative parts respectively carried by said flap and first compartment for releasably securing the flap to the first compartment, the bag being formed with an aperture through which one of said parts of said fixing means extends to secure the flap when the bag is in its unfolded condition.

5. A portable article carrier suitable for carrying goods by hand, wherein a capacious and foldable bag bears an attached case smaller than the unfolded bag, the attachment of the case to the bag being adjacent to an upper edge of the bag defining a mouth thereof and an upper edge of the case, said case comprising a compartment in which the bag can be stowed when folded, said compartment having an access aperture suitable for ingress of the folded bag, and wherein when the bag is unfolded the case hangs down inside the bag with the said access aperture adjacent to the upper edge attached to the bag and facing away from the central interior of the bag; wherein said case is provided with a flap hinged to the upper edge of the case adjacent to the upper edge of the bag, said flap being so adapted that when the bag is stowed, said flap can cover the access aperture and be releasably secured by respective parts of securing means on the flap and on the case below the access aperture, and wherein when the bag is unfolded, the flap can extend over the upper edge of the bag and said securing means can operate through an aperture in the bag and thereby hold the case against one side of the bag; further wherein said case comprises at least one further compartment separate from said compartment for stowage of the bag, said further compartment having a wholly closable access aperture on the side of the case facing the central hollow interior of the bag in the unfolded condition thereof, said further compartment thus being usable as a purse irrespective of whether the bag is stowed or unfolded; and wherein said bag comprises at least one foldable carrying handle adjacent to its upper edge and usable when the bag is unfolded.

* * * * *